US008348374B2

(12) United States Patent
Kusunoki

(10) Patent No.: US 8,348,374 B2
(45) Date of Patent: Jan. 8, 2013

(54) INK JET APPARATUS AND METHOD OF REDUCING CROSSTALK

(75) Inventor: Ryutaro Kusunoki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 225 days.

(21) Appl. No.: 12/879,987

(22) Filed: Sep. 10, 2010

(65) Prior Publication Data

US 2011/0063350 A1 Mar. 17, 2011

(30) Foreign Application Priority Data

Sep. 15, 2009 (JP) ..... 2009-213672

(51) Int. Cl.
*B41J 29/38* (2006.01)
*B41J 2/045* (2006.01)

(52) U.S. Cl. ..... 347/14; 347/69; 347/10; 347/12

(58) Field of Classification Search ..... 347/69, 347/10, 11, 12, 14
See application file for complete search history.

(56) References Cited

U.S. PATENT DOCUMENTS

| | | | | |
|---|---|---|---|---|
| 5,764,247 | A * | 6/1998 | Asai | 347/69 |
| 5,831,650 | A * | 11/1998 | Reinten | 347/68 |
| 6,416,149 | B2 * | 7/2002 | Takahashi | 347/10 |
| 7,367,658 | B2 | 5/2008 | Kusunoki et al. | |
| 7,625,053 | B2 | 12/2009 | Takanose et al. | |
| 7,669,987 | B2 | 3/2010 | Kusunoki et al. | |
| 2005/0099452 | A1 * | 5/2005 | Kusunoki | 347/40 |

* cited by examiner

*Primary Examiner* — Julian Huffman
(74) *Attorney, Agent, or Firm* — Patterson & Sheridan, LLP

(57) ABSTRACT

When ink is ejected from any one of a plurality of pressure chambers, an electric field pulse, which corresponds to an electric field pulse to be applied to a partition wall of the pressure chamber which is to eject the ink, and has at least one square wave, which is in a direction opposite to that of the electric field pulse and has a pulse width corresponding to the electric field pulse, is applied to a partition wall adjacent to the partition wall of the pressure chamber which is to eject the ink.

7 Claims, 13 Drawing Sheets

A-A SECTION

B-B SECTION (a) VOLTAGE OF ELECTRODE (b) ELECTRIC FIELD OF ACTUATOR (a) VOLTAGE OF ELECTRODE (b) ELECTRIC FIELD OF ACTUATOR (a) VOLTAGE OF ELECTRODE (b) ELECTRIC FIELD OF ACTUATOR

B-B SECTION (a) VOLTAGE OF ELECTRODE (b) ELECTRIC FIELD OF ACTUATOR

INK JET APPARATUS AND METHOD OF REDUCING CROSSTALK

CROSS-REFERENCE TO RELATED APPLICATION(S)

This application is based upon and claims the benefit of priority from Japanese Patent Application No, 2009-213672, filed on Sep. 15, 2009; the entire contents of which are incorporated herein by reference.

FIELD

Embodiments described in this specification relate to an ink jet technique of ejecting ink from a plurality of nozzles, and particularly, to a technique of reducing crosstalk which is generated when employing a shared-wall ink jet head.

BACKGROUND

Conventionally, ink jet heads employing a so-called "shared-wall head" system in which the partition walls of pressure chambers adjacent to each other serve as actuators are known. In the ink jet heads employing this system, pressure fluctuation, which is caused in the pressure chambers, deforms actuators and is spread to adjacent pressure chambers, and thus "crosstalk" is generated and variations are caused in the volume and speed of ink droplets which are ejected in accordance with an image pattern.

To cope with such problems, a technique is disclosed in which pressure fluctuation is purposely caused in pressure chambers which do not eject ink, by driving actuators with dummy pulses to compensate for changes in the volume and ejection speed of ink droplets due to crosstalk of the pressure fluctuation.

However, in the above-described conventional technique, since the pressure fluctuation which generates the crosstalk compensating for the change in ejection speed is restricted to a level where ink is not ejected from nozzles, it is difficult to obtain sufficient effects although changes in the volume and ejection speed due to the crosstalk can be reduced to a certain level.

In addition, in the above-described conventional technique, it is necessary to selectively supply to respective channels pulses for ejecting ink depending on the generation of dummy pulses and pulses with different voltages and a drive signal generating unit becomes complicated, so an inexpensive ink jet recording apparatus having high reliability cannot be provided.

In addition, a technique is disclosed in which the waveform of dummy pulses for correcting crosstalk is calculated on the basis of the response characteristics of the ink jet head and the dummy pulses of this waveform are provided to channels from which ink is not ejected. Although this technique is highly effective from the point of view of the elimination of crosstalk, a driving signal generating unit is required to generate an arbitrary waveform and thus the drive circuit becomes complicated and an inexpensive ink jet recording apparatus having high reliability cannot be provided.

In the conventional technique of correcting crosstalk, in order to set the appropriate crosstalk correction amount, the voltage amplitude of the driving signals for crosstalk correction is adjusted. Accordingly, a drive circuit of the conventional ink jet head is required to selectively supply to respective channels a drive voltage for correcting crosstalk as well as a drive voltage for ink ejection and thus the drive circuit becomes complicated.

The present invention is contrived in order to solve the above-described problems and an object of the invention is to provide a technique of reducing crosstalk, which is generated when employing a shared wall ink jet head, by simple drive control with lower power consumption than in the past.

DETAILED DESCRIPTION

In general, according to an embodiment, an ink jet recording apparatus has a plurality of partition walls, a plurality of electrodes and a drive signal generation portion.

The plurality of partition walls partition between a plurality of pressure chambers corresponding to and communicating with a plurality of ink ejection nozzles and can change volumes of the pressure chambers in accordance with the drive signal supplied. The plurality of electrodes are provided so as to correspond to the above-described plurality of pressure chambers. The drive signal generation portion supplies drive signals for ink ejection to an electrode corresponding to the pressure chamber which is to eject ink and an electrode corresponding to a pressure chamber adjacent to the above pressure chamber to apply a square-wave electric field pulse to the partition wall of the pressure chamber which is to eject ink. When ink is ejected from any one of the plurality of pressure chambers, the drive signal generation portion applies to a second partition wall adjacent to a first partition wall of the pressure chamber which is to eject ink, at a timing corresponding to an electric field pulse which is applied to the first partition wall, an electric field pulse composed of at least one square wave, which is in a direction opposite to that of the electric field pulse which is applied to the adjacent first partition wall and has a pulse width which is determined on the basis of the electric field pulse.

First Embodiment

First, a first embodiment will be described.

Figure 1:
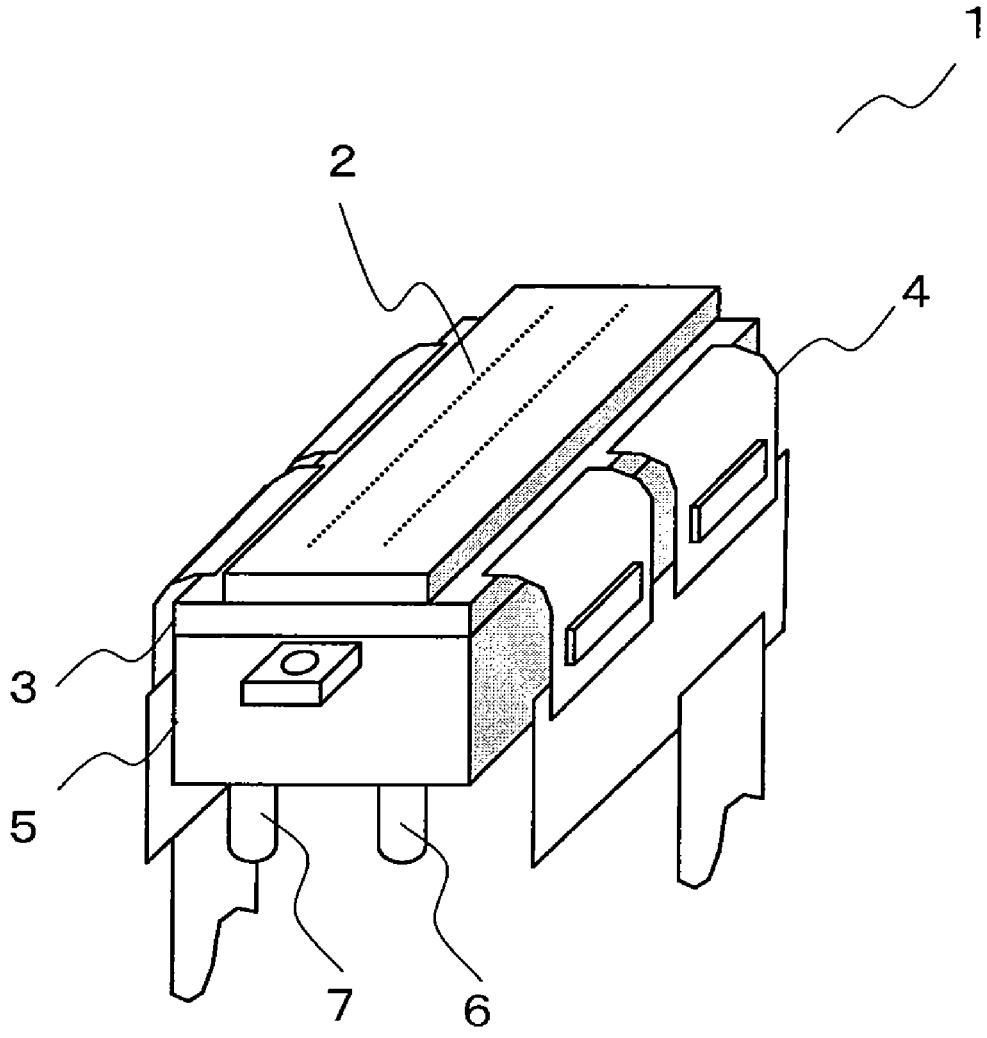
FIG. 1 is an appearance diagram of an ink jet head of a first embodiment.

FIG. 1 is a perspective view of an ink jet head 1 of an ink jet recording apparatus according to the first embodiment.

The ink jet head 1 is provided with a head substrate 3 having nozzles 2 for ejecting ink, a driver IC 4 generating drive signals (drive signal generator) and a manifold 5 having an ink supply port 6 and an ink discharge port 7.

The ink jet head 1 ejects from the nozzles 2 the ink supplied from the ink supply port 6 in accordance with a drive signal generated by the driver IC 4. The ink which is not ejected from the nozzles 2 among the ink flowing from the ink supply port 6 is discharged from the ink discharge port 7.

Figure 2:
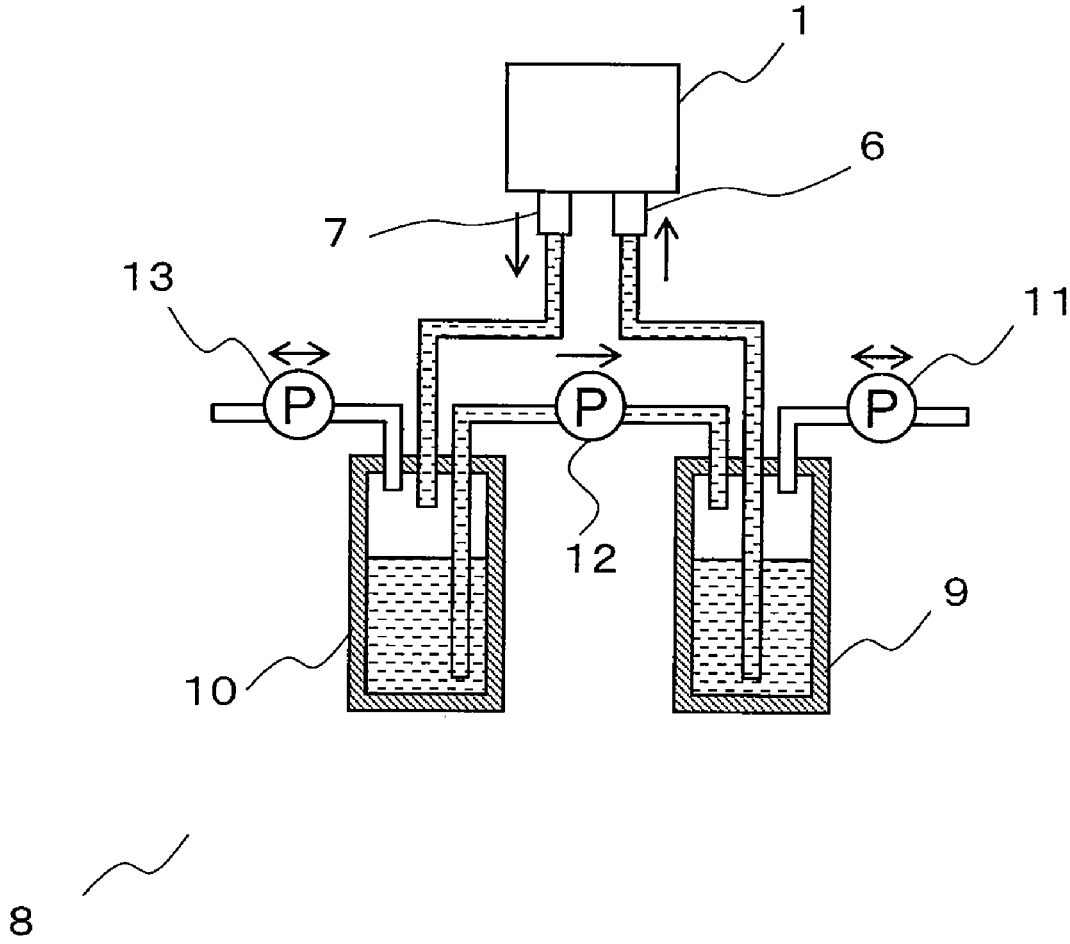
FIG. 2 is a configuration diagram of an ink supply apparatus of the first embodiment.

FIG. 2 is a schematic diagram of an ink supply apparatus 8 which is used in the ink jet recording apparatus according to the first embodiment. The ink supply apparatus 8 includes a supply-side ink tank 9, a discharge-side ink tank 10, a supply-side pressure adjustment pump 11, a transfer pump 12, a discharge-side pressure adjustment pump 13 and a tube fluidically connecting the above members to each other.

The supply-side pressure adjustment pump 11 and the discharge-side pressure adjustment pump 13 adjust the pressure in the supply-side ink tank 9 and the pressure in the discharge-side ink tank 10, respectively. The supply-side ink tank 9 supplies ink to the ink supply port 6 of the ink jet head 1. The discharge-side ink tank 10 temporarily stores the ink discharged from the ink discharge port 7 of the ink jet head 1. The transfer pump 12 circulates the ink stored in the discharge-side ink tank 10 back to the supply-side ink tank 9.

Next, the configuration of the ink jet head 1 will be described in detail.

Figure 3:
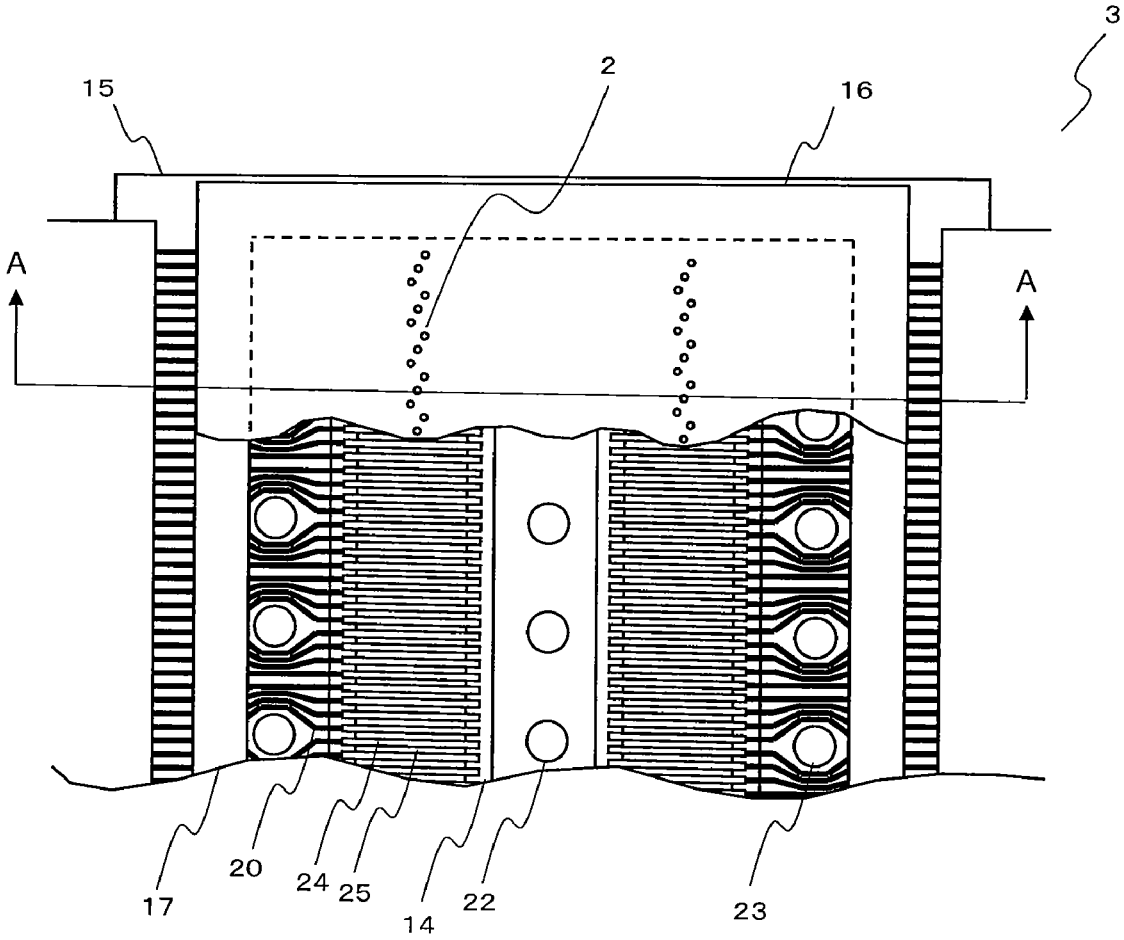
FIG. 3 is a top view of the ink jet head of the first embodiment.
Figure 4:
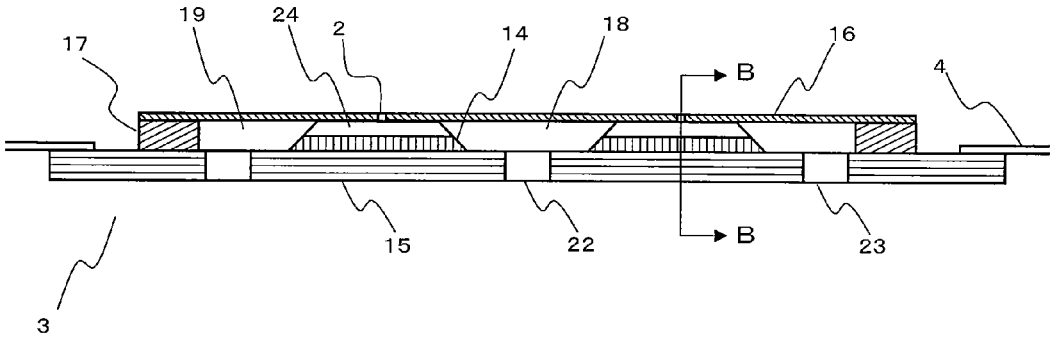
FIG. 4 is a longitudinal sectional view of the ink jet head of the first embodiment.
Figure 5:
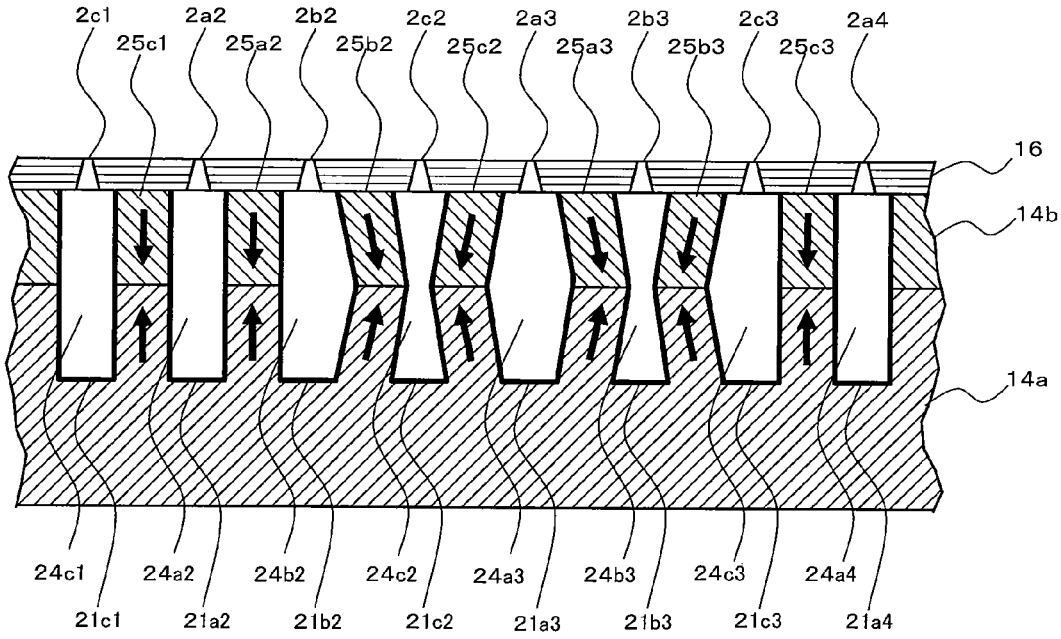
FIG. 5 is a transverse sectional view of the ink jet head of the first embodiment.

FIG. 3 is a top view of the head substrate 3. FIG. 4 is a longitudinal sectional view of the head substrate 3, taken along the line A-A. FIG. 5 is a transverse sectional view of the head substrate 3, taken along the line B-B. The head substrate 3 includes a piezoelectric member 14, a base substrate 15, a nozzle plate 16 and a frame member 17. The space of the center portion surrounded by the base substrate 15, the piezoelectric member 14 and the nozzle plate 16 forms an ink supply passage 18. The space surrounded by the base substrate 15, the piezoelectric member 14, the frame member 17 and the nozzle plate 16 forms an ink discharge passage 19.

In the base substrate 15, wiring electrodes 20, which electrically connect electrodes 21 formed in the inner surface of pressure chambers 24 to the driver IC 4, are formed (see FIG. 3). In addition, in the base substrate 15, ink supply holes 22 communicating with the ink supply passage 18 and ink discharge holes 23 communicating with the ink discharge passage 19 are formed. The ink supply holes 22 are fluidically connected to the ink supply port 6 by the manifold 5. The ink discharge holes 23 are fluidically connected to the ink discharge port 7 by the manifold 5. It is desirable that the base substrate 15 is made of a low-dielectric material having a small difference in the coefficient of thermal expansion with the piezoelectric member. Examples of the material for the base substrate 15 include alumina ($Al_2O_3$), silicon nitride ($Si_3N_4$) silicon carbide (SiC), aluminum nitride (AlN), piezoelectric zirconate titanate (PZT) and the like. In this embodiment, low-dielectric PTZ is used.

The piezoelectric member 14 is joined onto the base substrate 15. The piezoelectric member 14 is formed by laminating a piezoelectric member 14*a* and a piezoelectric member 14*b* which are mutually reversely polarized in the substrate thickness direction (see FIG. 5). In the piezoelectric member 14, a plurality of long grooves from the ink supply passage 18 to the ink discharge passage 19 are formed in parallel and electrodes 21 are formed in the inner surface of the long grooves. The space surrounded by the long groove and one surface of the nozzle plate 16 covering the long grooves provided on the piezoelectric member 14 serves as the pressure chamber 24. The electrodes 21 are connected to the driver IC 4 through the wiring electrodes 20. The piezoelectric member 14 constituting a partition wall between the adjacent pressure chambers 24 forms an actuator 25 so as to be interposed by the electrodes 21 provided in the pressure chambers 24. When an electric field is applied to the actuator 25 by a drive signal generated by the driver IC 4, the actuator 25 is shear-deformed into a dogleg shave at an apex employing the joint portion between the piezoelectric member 14*a* and the piezoelectric member 14*b*. Due to the deformation of the actuator 25, the volume of the pressure chamber 24 is changed and the ink in the pressure chamber 24 is pressurized. The pressurized ink is ejected from the nozzle 2. The material for the piezoelectric member 14 is piezoelectric zirconate titanate (PZT: Pb(Zr, Ti)$O_3$), lithium niobate ($LiNbO_3$), lithium tantalite ($LiTaO_3$) or the like. In this embodiment, piezoelectric zirconate titanate (PZT) with a high piezoelectric constant is used.

The electrode 21 has a two-layer structure of nickel (Ni) and gold (Au). The electrode 21 is uniformly film-formed in the long groove by, for example, plating. As a method other than plating for forming the electrode 21, sputtering or vapor deposition can also be used. The pressure chambers 24 have a shape with a depth of 300 μm and a width of 80 μm, and are arranged in parallel at a pitch of 169 μm.

The nozzle plate 16 is bonded to the piezoelectric member 14. In the nozzle plate 16, the nozzles 2 are formed at positions offset for every three cycles from the center portion in the longitudinal direction of the pressure chamber 24. As the material for the nozzle plate 16, a metal material such as stainless steel, an inorganic material such as single-crystal silicon or a resin material such as a polyimide film can be used. In this embodiment, an example is shown in which a polyimide film is employed. The nozzles can be formed with high accuracy by performing hole processing with excimer laser or the like after the adhesion of the nozzle plate 16 to the piezoelectric member 14. The nozzles 2 have a shape which is tapered toward the ink ejection side from the pressure chamber 24. When stainless steel is used as the material, the nozzles 2 can be formed by pressing. When single-crystal silicon is used as the material, the nozzles 2 can be formed by wet etching or dry etching by photolithography.

The shear-mode and sheared-wall ink jet head suitable for the application of the present invention was described as above. In the above description, a configuration was described in which the ink supply passage 18 is formed at one end of the pressure chamber 24, the ink discharge passage 19 is formed at the other end and the nozzle 2 is formed at the center portion of the pressure chamber 24. However, the application range of the present invention is not limited thereto. It will be obvious that the present invention also can be applied to a configuration in which the nozzle is formed at one end of the pressure chamber 24 and the ink supply passage is formed at the other end.

Figure 6:
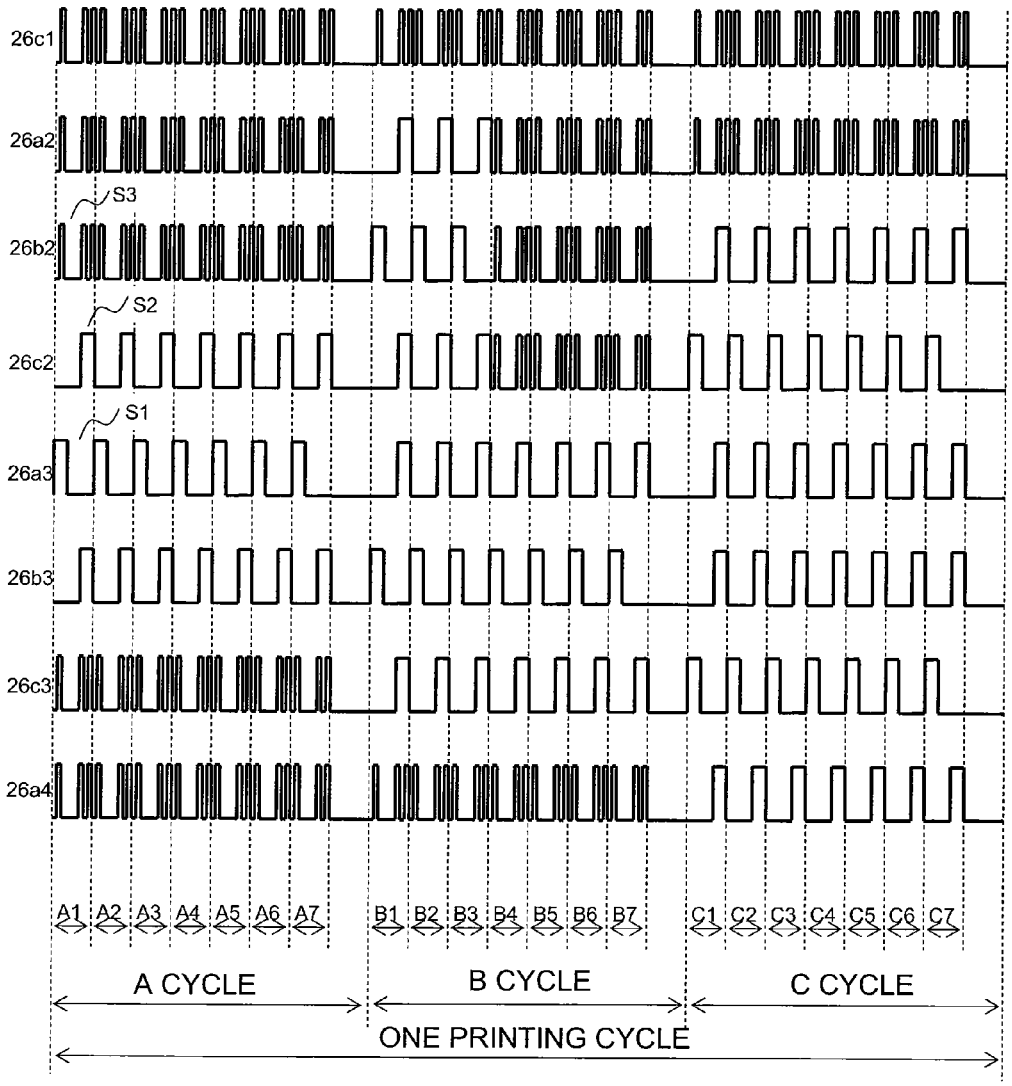
FIG. 6 is a diagram showing drive signals of the first embodiment.

FIG. 6 shows an example of drive signals which are supplied to channels 26*c*1 to 26*a*4 by the driver IC 4. Here, the "channel" is a set of the electrode 21, pressure chamber 24 and nozzle 2. One printing cycle of a drive signal is divided into three cycles, that is, an "A cycle", a "B cycle" and a "C cycle" and channels corresponding to the respective cycles are driven in a time-division manner. The cycle of each channel is assigned so as to not be the same as the cycle of an adjacent channel.

In one cycle, a maximum of 7 ink droplets are ejected. By changing the number of droplets which are ejected to one pixel, 8-tone printing of droplet number 0 to droplet number 7 is carried out. The symbols A1 to A7 are timings at which the respective first to seventh ink droplets are ejected in the A cycle. The same meaning is applied to the symbols B1 to B8 and C1 to C7. However, this embodiment is not limited to tone printing and also can be applied to a case in which only one droplet is ejected to a pixel to be printed or a case in which a plurality of droplets are ejected to a pixel to be printed.

There are three types of drive signals S1 to S3. The drive signal S1 is supplied to a channel which is to eject ink. The drive signal S2 is supplied to a channel adjacent to the channel which is to eject ink. The drive signal S3 is supplied to a channel which is not to eject ink and a channel adjacent to the channel which is not to eject ink.

Figure 7:
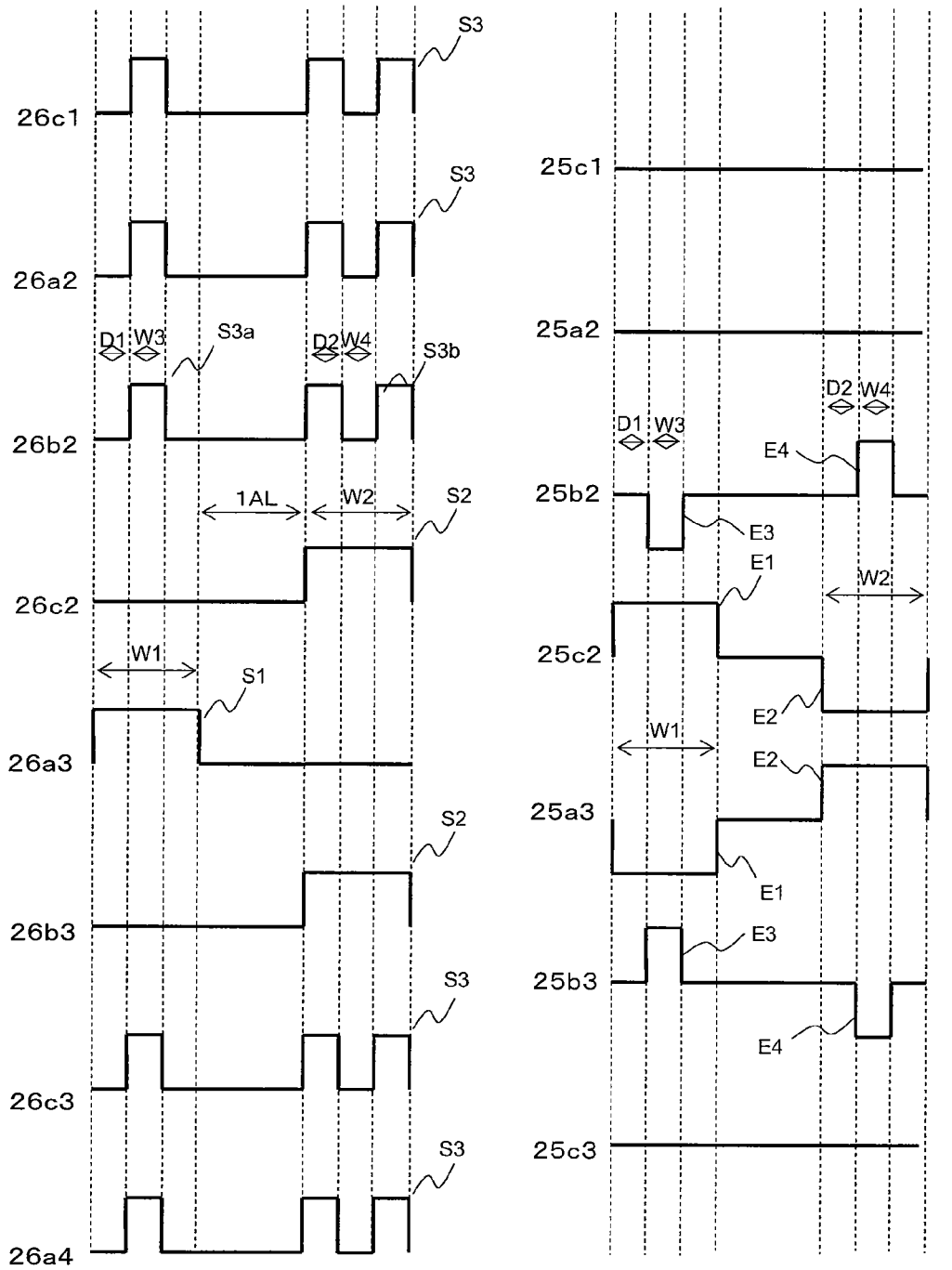
FIG. 7 is a detail view showing drive signals of the first embodiment.

FIG. 7(*a*) is a detail view showing the drive signals S1 to S3.

The drive signal S1 is a square-wave-like pulse with a pulse width W1 and causes ink to be ejected from the nozzle 2. The pulse width of W1 is preferably 1 AL. Here, "AL" is ½ of the acoustic resonance period of the ink in the pressure chamber 24. The drive signal S2 is a square-wave-like pulse with a pulse width W2 and causes the residual pressure oscillation in the pressure chamber 24 to be decreased. In this embodiment, the pulse width W2 is 1 AL, but may be adjusted in accordance with the rate of decreasing of the residual pressure oscillation.

The temporal center of the drive signal S2 is delayed by 2 AL with respect to the temporal center of the drive signal S1.

A drive signal S3*a* is a square-wave-like pulse with a pulse width W3 and a delay time D1 with respect to the drive signal S1, and corrects the crosstalk of the pressure oscillation caused by the drive signal S1. A drive signal S3*b* has two square, waves and corrects the crosstalk of the pressure oscillation caused by the drive signal S2. The rising timing of the first square wave is the same as in the drive signal S2 and the first square wave has a pulse width D2. The rising timing of the second square wave is equal to D2+W4 and the falling timing is the same as in the drive signal S2. The time of W3 and W4 are adjusted in accordance with crosstalk characteristics of the ink jet head. The drive signals S1 to S3 have the same voltage amplitude and the drive signals S1 to S3 can be generated by a minimum number of switching elements.

FIG. 7(*b*) shows electric fields which are generated in the actuators 25 by the drive signals S1 to S3. The polarity of an electric field shows a direction of the deformation of the actuator. When the drive signal S1 is supplied to the channel 26*a*3, an electric field pulse E1 acts on an actuator 25*a*3 and an actuator 25*c*2 constituting the side walls of an pressure chamber 24*a*3, and thus the volume of the pressure chamber 24*a*3 is expanded and returns to its original value after the elapse of 1 AL.

Pressure oscillation is caused in the ink inside due to this change in the volume and the ink is ejected from a nozzle 2*a*3. At the same time, due to changes in the volumes of pressure chambers 24*c*2 and 24*b*3, pressure oscillation is caused in the ink in the pressure chambers and this pressure oscillation deforms actuators 25*b*2 and 25*b*3 so as to cause pressure oscillation in pressure chambers 24*b*2 and 24*c*3. The pressure oscillation of the pressure chambers 24*b*2 and 26*c*3 becomes crosstalk. However, according to the configuration of this embodiment, an electric field pulse E3 acts on the actuators 25*b*2 and 25*b*3 by the action of the drive signal S3, and the deformation of the actuators 25*b*2 and 25*b*3 by the pressure oscillation of the pressure chambers 24*c*2 and 24*b*3 accompanied with the ink ejecting operation of the channel 26*a*3 is offset.

The present inventor thought that the phase of the pressure oscillation caused by the electric field pulse is determined by the temporal center of the electric field pulse, and thus examined the relationship between crosstalk and the time difference ΔT between the temporal center of the electric field pulse E1 and the temporal center of the electric field pulse E3. That is, $$D1=(W1-W3)/2+\Delta T;\text{ and}$$

$$D2=(W2-W4)/2+\Delta T$$

were established, and ΔT was changed in the range of −0.5 AL to 0.5 AL.

In this embodiment, the increase-decrease rate of the ink ejection volume when the channels are driven for every 6 channels at the same time with respect to the ink ejection volume when the surrounding channels are driven for every 3 channels at the same time is defined as "crosstalk".

When the increase-decrease rate is 0, this shows that the ink ejection volume is constant regardless of the drive patterns of the surrounding channels and there is no crosstalk.

Figure 8:
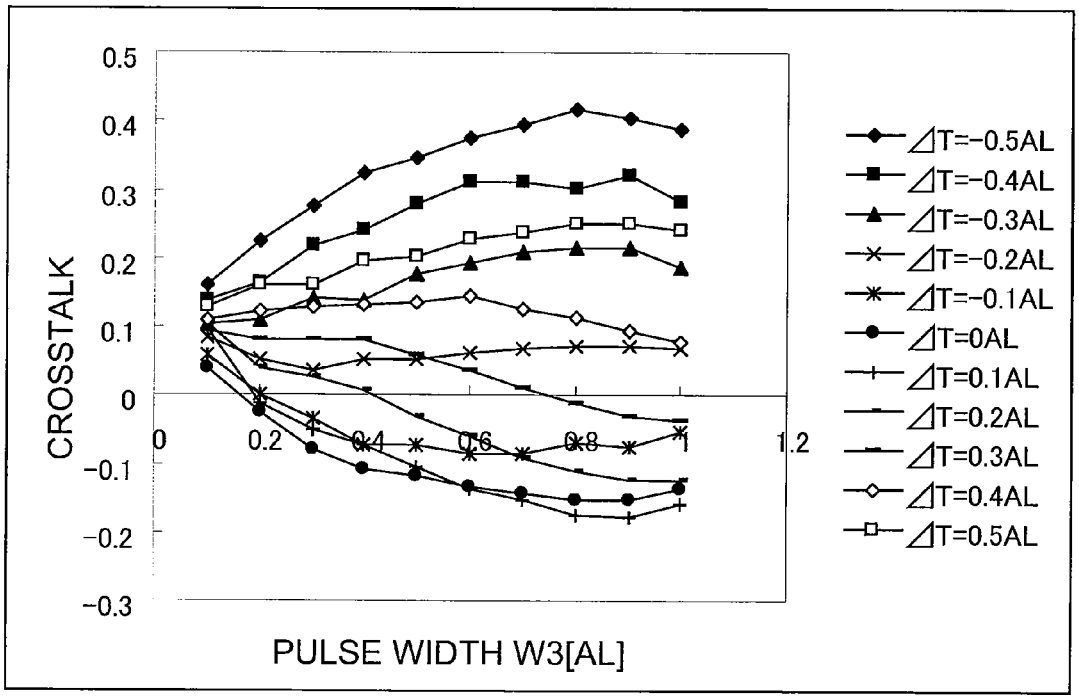
FIG. 8 is a diagram showing effects of the first embodiment.

FIG. 8 shows crosstalk when W1 and W2 are 1 AL, W3 is equal to W4, and ΔT and W3 are varied.

As is obvious from FIG. 8, when ΔT is in the range of −0.2 AL to 0.3 AL, by properly selecting the pulse width W3, the effect of reducing crosstalk by the drive signal S3 is shown. In addition, when ΔT is in the range of −0.1 AL to 0.1 AL, in a state in which the pulse width W3 is 0.2 AL, crosstalk is nearly zero and a remarkable crosstalk reduction effect is shown with a short pulse width. In this case, the residual pressure oscillation associated with the application of the drive signal S3 can be suppressed to a minimum and a high drive frequency can be maintained. That is, when ΔT is in the range of −0.1 AL to 0.1 AL, a high printing quality resulting from low crosstalk and a high printing speed resulting from a high drive frequency can be balanced.

In a conventional crosstalk correction technique, the voltage amplitude of a drive signal for crosstalk correction is adjusted in order to set an appropriate crosstalk correction amount. Accordingly, a drive circuit of the conventional ink jet head is required to selectively supply to respective channels a drive voltage for correcting crosstalk as well as a drive voltage for ink ejection and thus the drive circuit becomes complicated. In the technique of this embodiment, in order to set a crosstalk correction amount, an energization time W3 or W4 of the drive signal S3 for crosstalk correction is adjusted. In this manner, in this embodiment, when ink is ejected from any one of the plurality of pressure chambers, an electric field pulse (E3 or E4) having at least one square wave, which is in a direction opposite to that of an electric field pulse (E1 or E2) which is applied to a first partition wall of the pressure chamber which is to eject the ink, and has a pulse width which is determined on the basis of the electric field pulse, is applied to a second partition wall adjacent to the first partition wall, at a timing corresponding to the electric field pulse which is applied to the first partition wall. As a result, the voltage amplitude of the drive signal S3 for crosstalk correction can be made to be the same as in the drive signal S1 or S2 for ink ejection and the configuration of the drive circuit can be simplified.

The technological conception of this embodiment is correction of the pressure wave which is generated in a channel adjacent to a driven channel, and thus has the following difference to the conventional technological conception in which in a non-driven channel, such a pressure wave is generated that ink is not ejected. For example, when ink is ejected from the channel 26*a*3 and ink is not ejected from the channel 26*a*2, the actuator which is driven by the application of an electric field is only the actuator 25*b*2 in this embodiment. However, in the conventional technique, in addition to the actuator 25*b*2, an actuator 25*a*2 or 25*c*1 is also driven. That is, since this embodiment has a smaller number of driven actuators than the conventional technique, an efficient ink jet apparatus with low energy consumption can be provided.

Second Embodiment

Next, a second embodiment will be described.

The second embodiment is a modified example of the above-described first embodiment. Hereinafter, the same reference numerals will be assigned to parts having the same functions as those of the above-described parts in the embodiment and descriptions thereof will be omitted.

Figure 9:
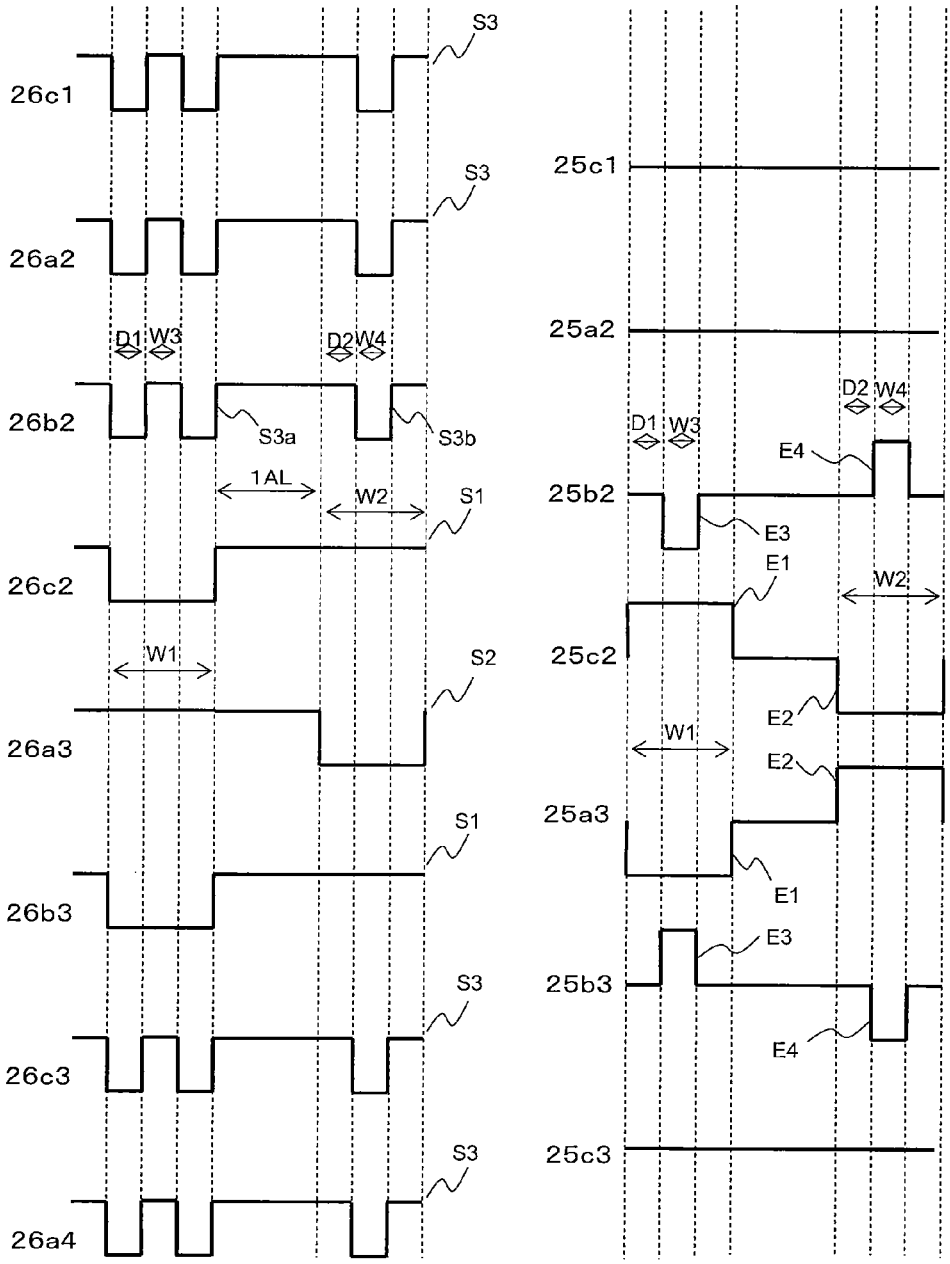
FIG. 9 is a detail view showing drive signals of a second embodiment.

FIG. 9 is a detail view showing drive signals S1 to S3 of the second embodiment. The polarization direction of actuators is the same as in the first embodiment.

Differences between the first embodiment and the second embodiment will be described. In the first embodiment, the drive signal S1 for ejecting ink is supplied to a channel which is to eject the ink. However, in the second embodiment, the drive signal S1 for ejecting ink is supplied to a channel adjacent to the channel which is to eject the ink.

In addition, in the first embodiment, the square waves of the drive signals S1 to S3 move in a positive logical manner which starts with the rising of the voltage and ends with the falling of the voltage. However, in the second embodiment, the square waves of the drive signals S1 to S3 move in a negative logical manner which starts with the falling of the voltage and ends with the rising of the voltage (see FIG. 9(*a*)).

However, as shown in FIG. 9(*b*), the movement of actuators is substantially the same as the movement in the first embodiment.

Third Embodiment

Next, a third embodiment will be described.

The third embodiment is a modified example of the above-described embodiments. Hereinafter, the same reference numerals will be assigned to parts having the same functions as those of the above-described parts in the embodiments and descriptions thereof will be omitted.

Figure 10:
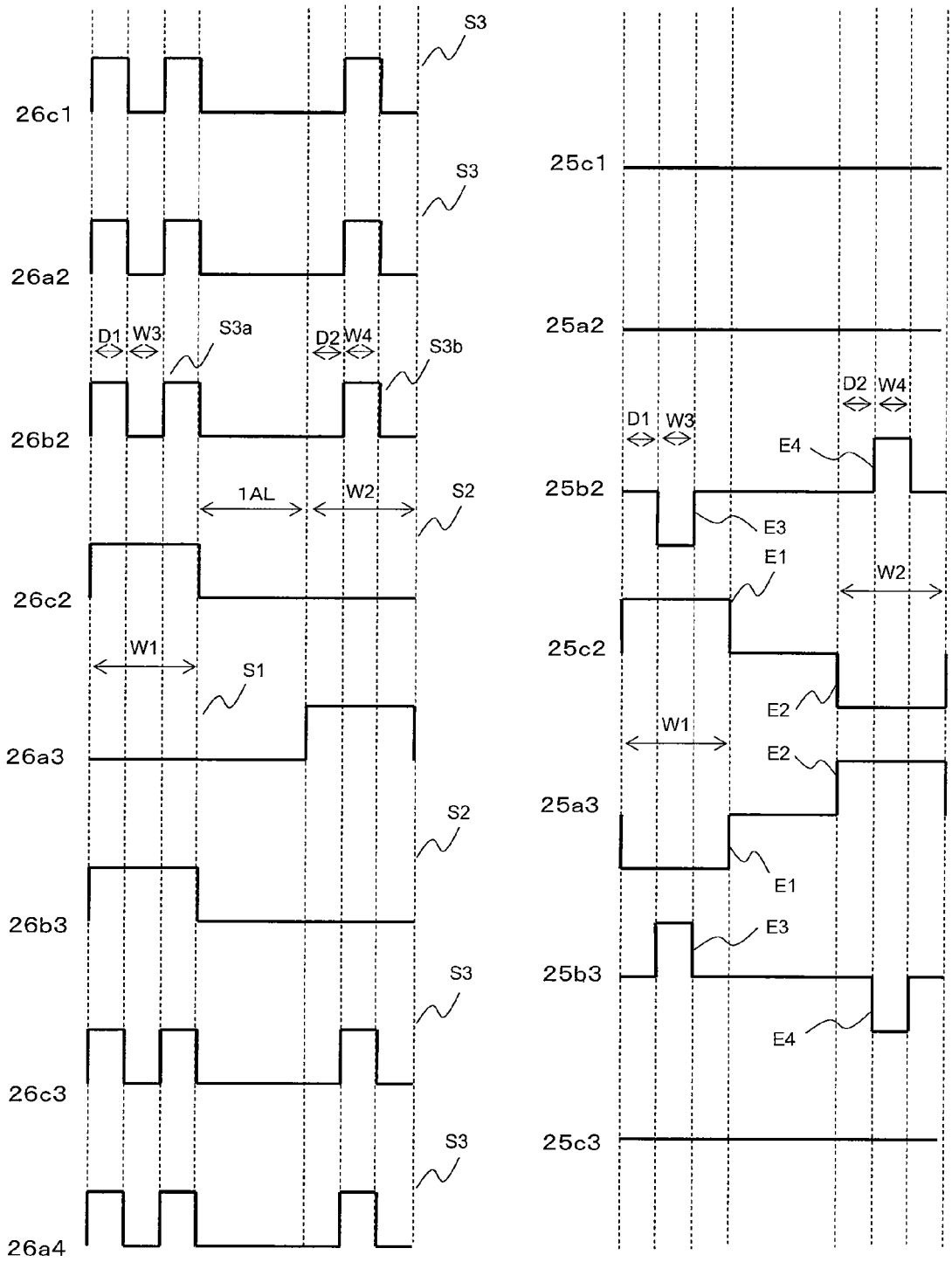
FIG. 10 is a detail view showing drive signals of a third embodiment.
Figure 11:
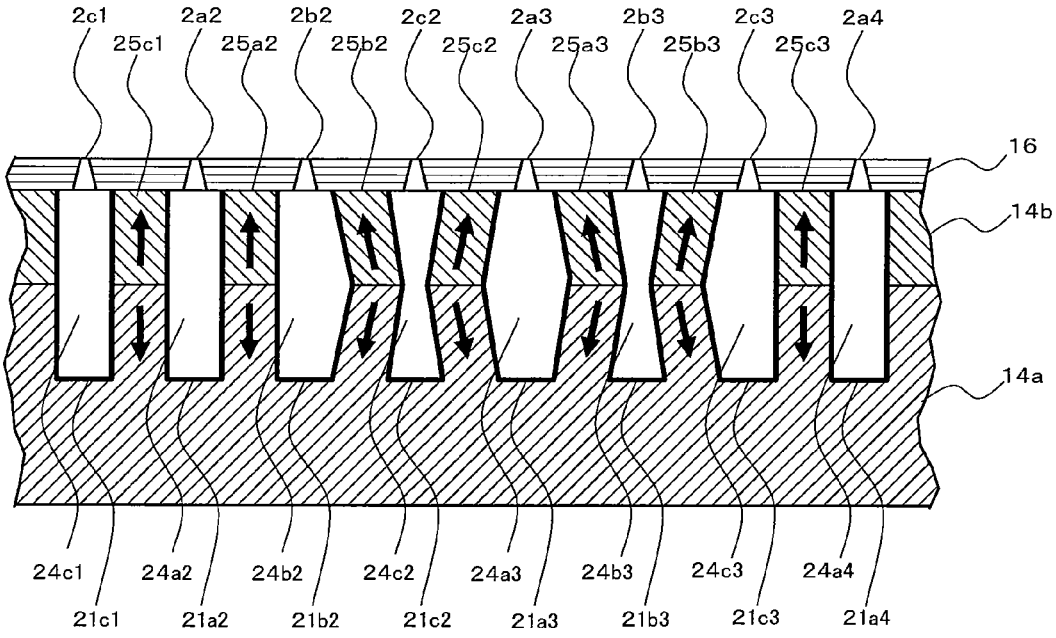
FIG. 11 is a transverse sectional view of an ink jet head of the third embodiment.

FIG. 10 is a detail view of drive signals S1 to S3 in the third embodiment. The polarization direction of actuators in this embodiment is opposite to that of the first or second embodiment as shown in FIG. 11.

In the third embodiment, the drive signal S1 for ejecting ink is supplied to a channel adjacent to a channel which is to eject the ink. However, unlike the second embodiment, square waves of the drive signals S1 to S3 move in a positive logical manner.

However, as shown in FIG. 10(*b*), the movement of actuators is substantially the same as in the first embodiment.

Fourth Embodiment

Next, a fourth embodiment will be described.

The fourth embodiment is a modified example of the above-described embodiments. Hereinafter, the same reference numerals will be assigned to parts having the same functions as those of the above-described parts in the embodiments and descriptions thereof will be omitted.

Figure 12:
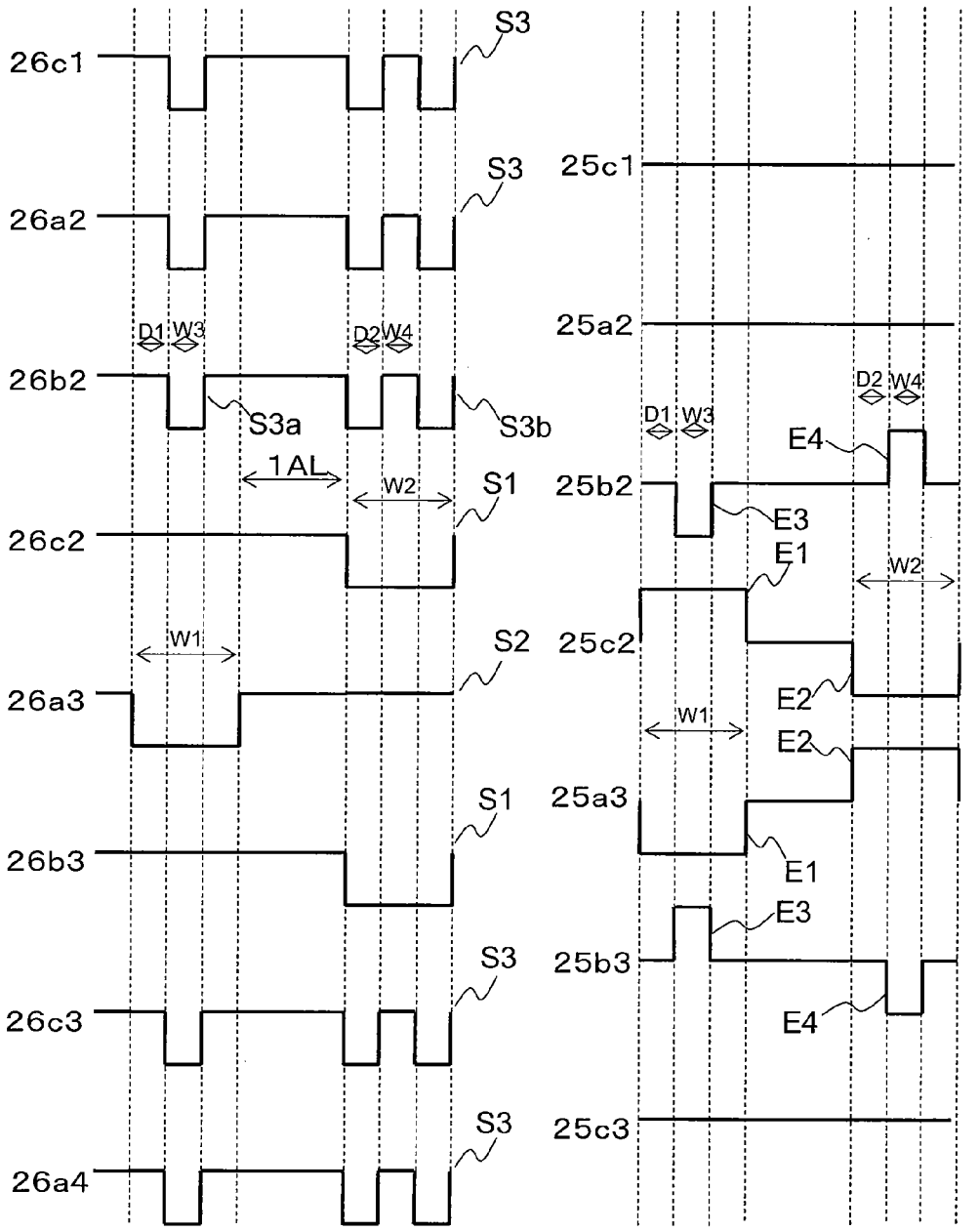
FIG. 12 is a detail view showing drive signals of a fourth embodiment.

FIG. 12 is a detail view for explaining drive signals S1 to S3 of the fourth embodiment. The polarization direction of actuators in this embodiment is opposite to that of the first or second embodiment as shown in FIG. 11.

In the fourth embodiment, the drive signal S1 for ejecting ink is supplied to a channel which is to eject the ink. However, unlike the first embodiment, square waves of the drive signals S1 to S3 move in a negative logical manner (see FIG. 12(*a*)).

However, as shown in FIG. 12(*b*), the movement of actuators is substantially the same as in the first embodiment.

Fifth Embodiment

Next, a fifth embodiment will be described.

The fifth embodiment is a modified example of the above-described embodiments. Hereinafter, the same reference numerals will be assigned to parts having the same functions as those of the above-described parts in the embodiments and descriptions thereof will be omitted.

In the above-described embodiments, a configuration was exemplified in which a square wave (for example, see E3 and E4 of FIG. 9) of a single electric field pulse having amplitude in a direction opposite to the direction in which a square wave (for example, see E2 of FIG. 9) of an electric field pulse, which is applied to a partition wall of the pressure chamber from which ink is ejected, and deforms the partition wall in a direction in which the volume of the pressure chamber is decreased, and a square wave (for example, see E1 of FIG. 9) of an electric field pulse, which deforms the partition wall in a direction in which the volume of the pressure chamber is increased, become convex is applied to a partition wall adjacent to the partition wall of the pressure chamber. However, the present invention is not necessarily limited thereto.

Figure 13:
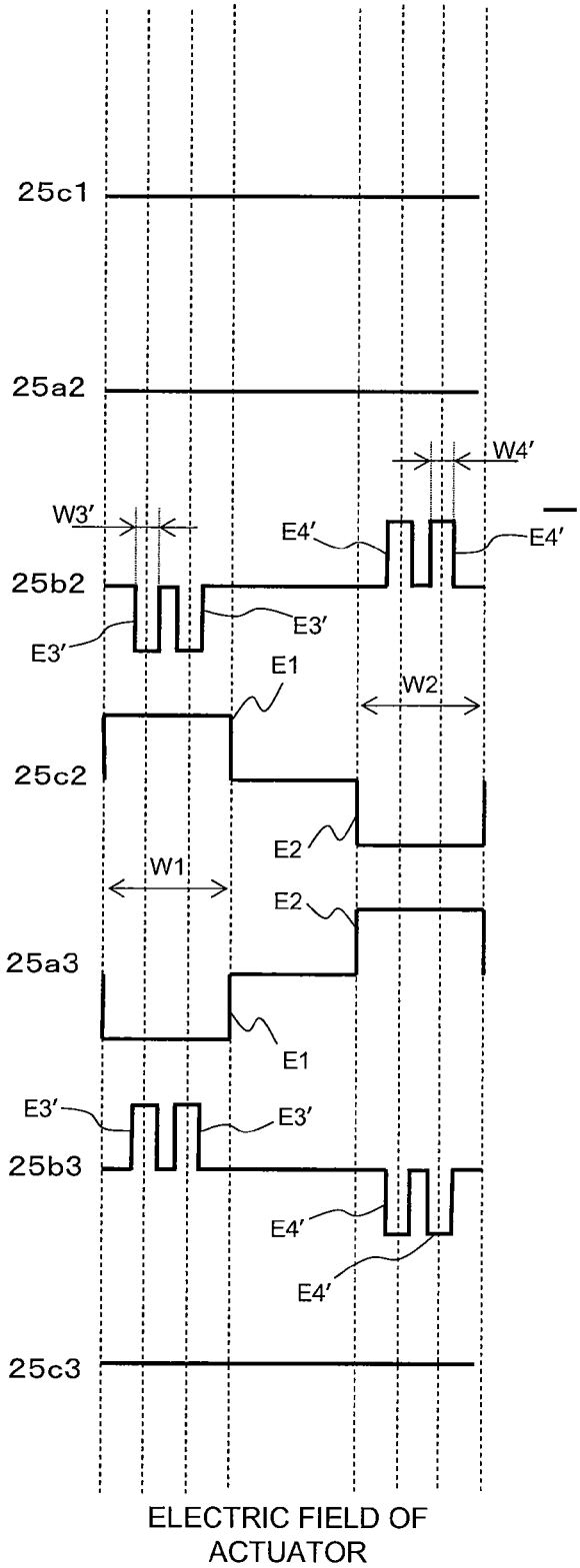
FIG. 13 is a diagram showing waveforms of electric field pulses applied to partition walls in a fifth embodiment.

For example, as shown in FIG. 13, square waves (for example, see a square wave E3' having a pulse width W3 and a square wave E4' having a pulse width W4' of FIG. 13) of a plurality of electric field pulses having amplitude in a direction opposite to the direction, in which a square wave (for example, see E2 of FIG. 9) of an electric field pulse deforming the partition wall in a direction in which the volume of the pressure chamber is decreased and a square wave (for example, see E1 of FIG. 9) of an electric field pulse deforming the partition wall in a direction in which the volume of the pressure chamber is increased become convex, may be applied to a partition wall adjacent to the partition wall of the pressure chamber.

In addition, in the example shown in FIG. 13, a configuration is shown in which the crosstalk caused by the square wave E1 is reduced by the two square waves E3' and the crosstalk caused by the square wave E2 is reduced by the two square waves E4'. However, the present invention is not necessarily limited thereto. Needless to say, the crosstalk caused by the square waves E1 and E2 may be reduced by three or more square waves.

In the above-described embodiments, a configuration was exemplified in which the drive signal which is supplied to a partition wall is generated by the driver IC4. However, the present invention is not necessarily limited thereto. For example, a CPU and a memory may be disposed in the ink jet recording apparatus according to the above-described embodiments such that the drive signal which is supplied to a partition wall is generated by executing a program stored in the memory on the CPU.

In addition, programs for executing the above-described various operations can be provided to the computer constituting the ink jet recording apparatus. In this embodiment, a case is exemplified in which the programs for realizing the functions embodying the present invention are recorded in advance in a storage area provided in the apparatus. However, the present invention is not limited thereto. The same programs may be downloaded to the apparatus from a network or a computer-readable recording medium in which the same programs are stored may be installed on the apparatus. The recording medium may have any form if it can store programs and is computer-readable. In greater detail, examples of the recording medium include an internal memory such as a ROM or a RAM which is internally mounted on the computer, a portable recording medium such as a CD-ROM, a flexible disk, a DVD disc, a magneto-optical disc or an IC card, a database for holding computer programs, another computer and a database thereon, a transmission medium on the line and the like. The functions which are obtained by previous installation or download may be realized by co-working with the operating system (OS) or the like in the apparatus.

In addition, some or all of the programs may be execution modules which are dynamically generated.

According to the above-described embodiment, by employing a configuration in which the energization time W3 or W4 of the drive signal S3 for crosstalk correction is adjusted in order to set the crosstalk correction amount, the voltage amplitude of the drive signal S3 for crosstalk correction can be made the same as that of the drive signal S1 or S2 for ink ejection and an effect of simplifying the drive circuit can be obtained.

In addition, the technological conception according to the above-described embodiments is correction of the pressure wave which is generated in a channel adjacent to a driven channel, and thus has the following difference with the conventional technological conception in which in a non-driven channel, a pressure wave is generated such that ink is not ejected. For example, when ink is ejected from the channel 26*a*3 and ink is not ejected from the channel 26*a*2, the actuator which is driven by the application of an electric field is only the actuator 25*b*2 in the above-described embodiments. However, in the conventional technique, in addition to the actuator 25*b*2, the actuator 25*a*2 or 25*c*1 is also driven.

That is, in the ink jet recording apparatus according to the above-described embodiments, since the number of actuators to be driven is smaller than in an ink jet recording apparatus having a conventional configuration, the ink jet recording apparatus according to the above-described embodiments is lower in energy consumption and is more efficient.

As described above, according to the technique described in this specification, a technique of reducing crosstalk, which is generated when employing a sheared-wall ink jet head, by simple drive control with a lower power consumption than in the past can be provided.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An ink jet recording apparatus comprising:

a plurality of partition walls which partition between a plurality of pressure chambers corresponding to and communicating with a plurality of ink ejection nozzles and can change the volumes of the pressure chambers in accordance with a drive signal supplied;

a plurality of electrodes which are provided so as to correspond to the plurality of pressure chambers; and a drive signal generation portion which supplies drive signals to an electrode corresponding to a first pressure chamber which is to eject ink and an electrode corresponding to a second pressure chamber adjacent to the above first pressure chamber to generate a square-wave electric field pulse that is applied to a partition wall of the first pressure chamber which is to eject ink, wherein when ink is ejected from any one of the plurality of pressure chambers, the drive signal generation portion applies to a second partition wall adjacent to a first partition wall of a pressure chamber which is to eject ink, at a timing corresponding to an electric field pulse which is applied to the first partition wall, an electric field pulse having at least one square wave, which is in a direction opposite to that of the electric field pulse which is applied to the first partition wall and has a pulse width which is determined on the basis of the electric field pulse which is applied to the first partition wall of the pressure chamber which is to eject ink.

2. An ink jet recording apparatus comprising:

a plurality of electrodes which correspond to a plurality of pressure chambers corresponding to and communicating with a plurality of ink ejection nozzles;

an actuator which forms a partition wall shared with an adjacent pressure chamber, and changes the volume of the adjacent pressure chamber in accordance with a drive signal which is supplied to a corresponding electrode; and a drive signal generation portion which generates the drive signal driving the actuator to change the volume of the pressure chamber at a time-division number of 3, wherein the drive signal generation portion supplies drive signals to an electrode corresponding to a pressure chamber which is to eject ink and to an electrode corresponding to a pressure chamber adjacent to the pressure chamber so as to generate a square-wave electric field pulse that is applied to an actuator forming a partition wall of the pressure chamber which is to eject ink, thereby ejecting ink, and the drive signal generation portion supplies drive signals for crosstalk correction to an electrode corresponding to a pressure chamber, which is not to eject ink even at a timing at which ink can be ejected, and to an electrode corresponding to a pressure chamber adjacent to the pressure chamber so as to apply a square-wave electric field pulse to an actuator forming a partition wall of a pressure chamber adjacent to the pressure chamber which is to eject ink, on the side of the pressure chamber which is not to eject ink, thereby causing pressure oscillation for crosstalk correction, and a time difference between the temporal center of a square-wave electric field pulse which is applied to the actuator forming the partition wall of the pressure chamber which is to eject ink and the temporal center of a square-wave electric field pulse which is applied to the actuator forming the partition wall of the pressure chamber which is adjacent to the pressure chamber which is to eject ink, on the side of the pressure chamber which is not to eject ink is in the range of −0.2 AL to 0.3 AL when AL is set to ½ of the acoustic resonance period of the ink in the pressure chamber.

3. The apparatus according to claim 2, wherein the time difference between the temporal center of a square-wave electric field pulse which is applied to the actuator forming the partition wall of the pressure chamber which is to eject ink and the temporal center of a square-wave electric field pulse which is applied to the actuator forming the partition wall, of the pressure chamber which is adjacent to the pressure chamber which is to eject ink, on the side of the pressure chamber which is not to eject ink is in the range of −0.1 AL to 0.1 AL when AL is set to ½ of the acoustic resonance period of the ink in the pressure chamber.

4. A crosstalk reduction method for an ink jet recording apparatus including a plurality of partition walls which partition between a plurality of pressure chambers corresponding to and communicating with a plurality of ink ejection nozzles and can change the volumes of the pressure chambers in accordance with a drive signal supplied, a plurality of electrodes which are provided so as to correspond to the plurality of pressure chambers, and a drive signal generation portion which supplies drive signals to an electrode corresponding to a first pressure chamber which is to eject ink and an electrode corresponding to a second pressure chamber adjacent to the above first pressure chamber to generate a square-wave electric field pulse that is applied to a partition wall of the first pressure chamber which is to eject ink, the method comprising:

applying to a second partition wall adjacent to a first partition wall of a pressure chamber which is to eject ink, at a timing corresponding to an electric field pulse which is applied to the first partition wall, an electric field pulse having at least one square wave, which is in a direction opposite to that of the electric field pulse which is applied to the first partition wall and has a pulse width which is determined on the basis of the electric field pulse which is applied to the first partition wall of the pressure chamber when ink is ejected from any one of the plurality of pressure chambers.

5. A crosstalk reduction method for an ink jet recording apparatus including a plurality of electrodes which correspond to a plurality of pressure chambers corresponding to and communicating with a plurality of ink ejection nozzles, an actuator which forms a partition wall shared with an adjacent pressure chamber and changes the volume of the adjacent pressure chamber in accordance with a drive signal which is supplied to a corresponding electrode, and a drive signal generation portion which generates the drive signal driving the actuator to change the volume of the pressure chamber at a time-division number of 3, wherein the drive signal generation portion supplies drive signals to an electrode corresponding to a pressure chamber which is to eject ink and to an electrode corresponding to a pressure chamber adjacent to the pressure chamber so as to generate a square-wave electric field pulse to be applied to an actuator forming a partition wall of the pressure chamber which is to eject ink, thereby ejecting ink, and the drive signal generation portion supplies drive signals for crosstalk correction to an electrode corresponding to a pressure chamber, which is not to eject ink even at a timing at which ink can be ejected, and to an electrode corresponding to a pressure chamber adjacent to the pressure chamber so as to apply a square-wave electric field pulse to an actuator forming a partition wall of a pressure chamber adjacent to the pressure chamber which is to eject ink, on the side of the pressure chamber which is not to eject ink, thereby causing pressure oscillation for crosstalk correction, and a time difference between the temporal center of a square-wave electric field pulse which is applied to the actuator forming the partition wall of the pressure chamber which is to eject ink and the temporal center of a square-wave electric field pulse which is applied to the actuator forming the partition wall of the pressure chamber which is adjacent to the pressure chamber which is to eject ink, on the side of the pressure chamber which is not to eject ink is in the range of −0.2 AL to 0.3 AL when AL is set to ½ of the acoustic resonance period of the ink in the pressure chamber.

6. An ink jet recording apparatus comprising:

a plurality of pressure chambers each corresponding to and communicating with an ink ejection nozzle and changing the volume of the pressure chamber in accordance with a drive signal supplied;

a first partition wall which partitions between a first pressure chamber and a second pressure chamber adjacent to the first pressure chamber, and has a first surface facing the first pressure chamber and a second surface facing the second pressure chamber;

a second partition which partitions between the second pressure chamber and a third pressure chamber adjacent to the second pressure chamber and different than the first pressure chamber, and has a third surface facing the second pressure chamber and a fourth surface facing the third pressure chamber;

a first electrode provided on the first surface;

a second electrode provided on the second surface;

a third electrode provided on the third surface;

a fourth electrode provided on the fourth surface; and a drive signal generator which supplies a first drive signal between the first and second electrodes to apply a first square-wave electric field pulse having an electric field direction so as to eject ink from the first pressure chamber, and supplies a second drive signal between the third and fourth electrodes to apply an electric field pulse having at least one square-wave, which is in a direction opposite to the electric field direction and has a pulse width which is determined on the basis of the first electric field pulse.

7. The ink jet recording apparatus according to claim 6, wherein the second and third electrodes are connected to one another.

* * * * *